United States Patent [19]

Lange

[11] Patent Number: 4,741,805

[45] Date of Patent: May 3, 1988

[54] GUIDING APPARATUS FOR GUIDING AN EXTENDED NIP PRESS BLANKET

[75] Inventor: David V. Lange, Beloit, Wis.

[73] Assignee: Beloit Corporation, Beloit, Wis.

[21] Appl. No.: 76,826

[22] Filed: Jul. 23, 1987

[51] Int. Cl.[4] ..... D21F 3/02

[52] U.S. Cl. ..... 162/205; 100/153; 162/358; 162/361

[58] Field of Search ..... 162/205, 358, 361; 29/113 AD, 116 AD; 100/118, 153, 154

[56] References Cited

U.S. PATENT DOCUMENTS

| | | | |
|---|---|---|---|
| Re. 31,923 | 6/1985 | Justus et al. | 162/358 |
| 4,584,059 | 4/1986 | Schiel et al. | 162/358 |
| 4,673,461 | 6/1987 | Roerig et al. | 162/358 |

FOREIGN PATENT DOCUMENTS

| | | | |
|---|---|---|---|
| 3224007 | 12/1983 | Fed. Rep. of Germany | 162/358 |

*Primary Examiner*—S. Leon Bashore
*Assistant Examiner*—K. M. Hastings
*Attorney, Agent, or Firm*—Dirk J. Veneman; Raymond W. Campbell; David J. Archer

[57] ABSTRACT

A guiding apparatus is disclosed for guiding an extended nip press blanket relative to a pressing shoe. The apparatus includes a nose member which is pivotally-connected to the shoe for guiding the blanket relative to the shoe. An actuator is secured to the shoe for pivoting the nose member relative to the shoe. A connector extends between the actuator and the nose member for connecting the actuator to the nose member such that when the actuator is actuated, the nose member is skewed relative to the shoe so that the blanket is guided laterally relative to the shoe as the blanket moves over, and in contact with, the nose member.

18 Claims, 5 Drawing Sheets

GUIDING APPARATUS FOR GUIDING AN EXTENDED NIP PRESS BLANKET

BACKGROUND OF THE INVENTION

1. Field of the Invention

This invention relates to a guiding apparatus for guiding an extended nip press blanket relative to a pressing shoe. More specifically, this invention relates to a guiding apparatus for guiding an extended nip press blanket relative to a pressing shoe of an enclosed, or so-called "apple type" extended nip press.

2. Information Disclosure Statement

In the prior art, it is known to provide a felt-supported web which extends through an extended nip defined by an elongate hydraulically-loaded shoe and a rotatable backing roll. A flexible blanket is disposed between the shoe and the felt such that as the blanket slides over the shoe and through the extended nip, the blanket is pressed towards the backing roll with the felt disposed between the blanket and the web for dewatering the formed web.

The extended nip press blanket usually includes a urethane material and is guided relative to the shoe by means of guide rolls disposed upstream and downstream respectively relative to the shoe. In order to maintain the correct alignment of the blanket relative to the shoe, one of the guide rolls includes adjustable journal bearings such that the axis of the guide roll relative to the shoe can be adjusted, or skewed, in order to guide the blanket laterally relative to the shoe.

In View of the requirement for supplying lubricant between the shoe and the blanket passing thereover, certain problems have been experienced in the prior art proposals in that this lubricant sometimes contaminates the supported felt and web. Because of this tendency towards contamination and marking of the resultant web, a totally enclosed shoe has been proposed. The afore-mentioned enclosed shoe arrangement known as the "apple extended nip press" is disclosed in U.S. Pat. No. Re. 31,923 assigned to Beloit Corporation. The "apple extended nip press" includes a blanket which is guided in an apple-shaped configuration through the extended nip and continuously around support means.

U.S. Pat. No. 4,673,461 to Roerig et al and assigned to Beloit Corporation teaches an annular flexible seal which extends between a rotatable head and the edge of the blanket for enclosing the blanket and preventing lubricant from contaminating the web.

However, with the provision of the totally enclosed blanket, the aforementioned guiding rolls for adjusting the skew of the blanket are not possible because no guiding rolls are used in the "apple extended nip press" configuration.

The present invention provides means for guiding the blanket relative to the shoe, such means enabling skewing of the blanket relative to the shoe so that lateral alignment of the blanket relative to the shoe is possible.

Therefore, it is primary objective of the present invention to provide a guiding apparatus which overcomes the problems associated with the aforementioned proposals and which provides a significant contribution to the extended nip pressing art.

Another object of the present invention is the provision of a guiding apparatus for guiding an extended nip press blanket relative to a pressing shoe in which a nose member pivotally-connected to the shoe guides the blanket relative to the shoe.

Another object of the present is the provision of a guiding apparatus which includes actuating means secured to the shoe for pivoting the nose member relative to the shoe.

Another object of the present invention is the provision of a guiding apparatus which includes connecting means extending between the actuating means and the nose member for connecting the actuating means to the nose member such that when the actuating means is actuated, the nose member is skewed relative to the shoe so that the blanket is guided laterally relative to the shoe as the blanket moves over, and in contact with, the nose member.

Another object of the present invention is the provision of a nose member which defines an elongate convex surface which contacts the blanket such that the blanket moves in a direction over the convex surface of the nose member onto the shoe.

Another object of the present invention is the provision of a guiding apparatus in which the nose member includes a central portion having a first and a second end with the first and second extension extending laterally from the first and second ends, the central portion being pivotally-connected to the shoe such that the nose member pivots midway between the first and second ends of the central portion.

Another object of the present invention is the provision of a guiding apparatus which includes a tongue portion extending from the shoe in a direction opposite to the machine direction and a first pivot pin extending from the tongue portion such that the nose member pivots midway between the first and the second end of the central portion about the first pivot pin.

Another object of the present invention is the provision of a guiding apparatus in which the nose member also includes a projection. The projection is slidably received within a slot defined by the shoe so that a second pivot pin extending into the shoe and through the slot pivotally secures the nose member relative to the shoe.

Another object of the present invention is the provision of a guiding apparatus in which the shoe includes a supporting portion which extends from the shoe for supporting the nose member such that during pivotal movement of the nose member relative to the shoe, the support portion supports the nose member with the nose member being disposed between the blanket and the support portion.

Another object of the present invention is the provision of a guiding apparatus including a first and a second arm which extend respectively from the first and second ends of the central portion to respectively the first and second sides of the shoe. The first and second arms define respectively a first and second longitudinal guideway for the reception therein of the first and second extensions respectively such that skewing of the nose member relative to the shoe is permitted.

Another object of the present invention is the provision of a guiding apparatus in which a third and fourth extension extend laterally relative to the central portion with the third and fourth extensions cooperating respectively with first and second grooves defined respectively by the first and second arms such that skewing of the central portion relative to the shoe is permitted, the skewing being only in a plane parallel to the plane of the blanket when the blanket is guided from the nose member onto the shoe.

Another object of the present invention is the provision of a guiding apparatus in which the actuator is an air cylinder pivotally-secured to the shoe.

Other objects and advantages of the present invention will be apparent to those skilled in the art by a consideration of the detailed description contained hereinafter taken in conjunction with the annexed drawings.

SUMMARY OF THE INVENTION

The present invention relates to a guiding apparatus and method for guiding an extended nip press blanket relative to a pressing shoe. The apparatus includes a nose member which is pivotally-connected to the shoe for guiding the blanket relative to the shoe. An actuating means is secured to the shoe for pivoting the nose member relative to the shoe and a connecting means extends between the actuating means and the nose member for connecting the actuating means to the nose member such that when the actuating means is actuated, the nose member is skewed relative to the shoe so that the blanket is guided laterally relative to the shoe as the blanket moves over, and in contact with, the nose member.

In a more specific embodiment of the present invention, the nose member defines an elongate, convex surface which contacts the blanket such that the blanket moves in a direction over the convex surface of the nose member onto the shoe. More specifically, the nose member defines an elongate curved surface with the curved surface being curved convexly in a machine direction and cooperating with the blanket for guiding the blanket onto the shoe.

The nose member also includes a central portion which defines the curved surface. The curved surface cooperates with the blanket for guiding the blanket onto the shoe and the central portion has a first and a second end. A first and a second extension extend laterally from the first and second ends respectively of the central portion.

The central portion is pivotally-connected to the shoe such that the nose member pivots midway between the first and second ends of the central portion.

In a first embodiment of the present invention, a tongue portion extends from the shoe in the machine direction and a first pivot pin extends from the tongue portion. The first pivot pin cooperates with the central portion of the nose member such that the nose member pivots midway between the first and the second end of the central portion. More specifically, the tongue portion defines a first hole for the reception therein of the first pin and the central portion defines a second hole which is disposed midway between the first and the second end of the central portion. The second hole is disposed coaxial relative to the first hole such that the first pin extends through the first and second holes so that the nose member pivots relative to the tongue portion.

In a second embodiment of the present invention, the nose member further includes a projection with the projection defining a third hole. The projection is slidably received within a slot defined by the shoe and a second pivot pin extends into the shoe such that the second pin extends through the slot and the second hole for pivotally securing the nose member relative to the shoe. A supporting portion extends from the shoe for supporting the nose member such that during pivotal movement of the nose member relative to the shoe, the support portion supports the nose member with the nose member being disposed between the blanket and the support portion.

In a third embodiment of the present invention, a first and a second arm extend respectively from the first and second ends of the central portion to respectively the first and second side of the shoe. The first and second arms define respectively first and second longitudinal guideways for the slidable reception therein of the first and second extensions respectively such that skewing of the nose member relative to the shoe is permitted.

A third and fourth extension extend laterally relative to the central portion with the third and fourth extensions extending respectively from the first and second ends of the central portion. The first and second arms define respectively first and second grooves for the slidable reception therein of the third and fourth extensions respectively. The first and second grooves extend longitudinally relative to the first and second arms respectively with the first and second grooves being an extension of the first and second guideways such that skewing of the central portion relative to the shoe is permitted—the skewing being only in a plane parallel to the plane of the blanket when the blanket is guided from the nose member onto the shoe.

In each of the aforementioned embodiments the actuating means is an air cylinder with the air cylinder being pivotally-secured to the shoe. More specifically, the actuating means includes a clevis which is rigidly secured to the shoe and a clevis pin extending through the clevis and the air cylinder such that the air cylinder is permitted to pivot relative to the shoe. The clevis pin has a longitudinal axis which is disposed normal to the longitudinal plane of the blanket as the blanket is guided over the shoe.

In each of the aforementioned embodiments the connecting means is pivotally-connected to the first and second extensions respectively such that when the actuating means is actuated, the nose member is skewed relative to the shoe. More specifically, the connecting means also includes a first and second bifurcated coupling. The first and second extensions define respectively, first and second bores and a third and fourth pivot pin extend respectively through the first coupling and first extension and through the second coupling and second extension.

In each of the aforementioned embodiments the guiding apparatus also includes a lubricant supply means secured to the nose member such that the nose member is disposed between the supply means and the shoe for supplying lubricant between the blanket and the nose member such that the blanket slides over the nose member and the shoe.

As will be apparent to those skilled in the art, many variations and modifications may be made to the embodiments described hereinafter and these modifications and variations do not depart from the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
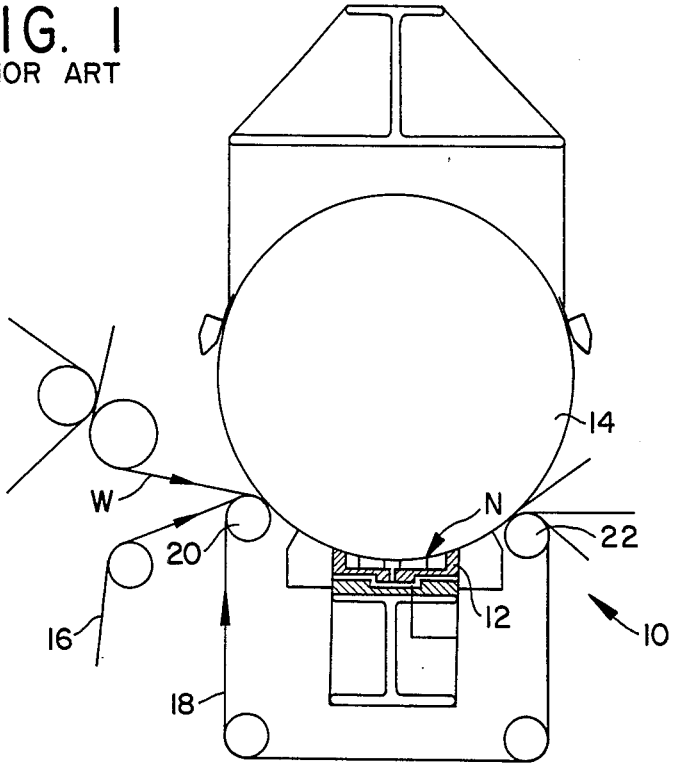
FIG. 1 PRIOR ART
FIG. 1 is a side-elevational view of a prior art extended nip press of the non-enclosed type having adjustable guide rolls.

FIG. 1 is a side-elevational view of a prior art extended nip press generally designated 10 in which a shoe 12 is hydraulically urged towards a backing roll 14 to define therebetween an extended nip N for the passage therethrough of a web W supported by a felt 16. A blanket 18 extends through the nip N with the blanket 18 being lubricated such that the blanket 18 slides relative to the shoe 12. The arrangement is such that when the blanket 18 extends through the nip N the blanket 18 is urged towards the backing roll 14 with the felt 16 disposed between the web W and the blanket 18 thereby pressing excess water from the formed web W. In order to maintain the correct alignment between the blanket 18 and the shoe 12 guide rolls 20 and 22 are provided respectively upstream and downstream relative to the shoe 12. The guide roll 20 includes adjustable journal bearings such that the rotational axis of the guide roll 20 may be adjusted relative to the shoe 12 thereby skewing the blanket 18 to obtain the correct lateral adjustment of the blanket 18 relative to the shoe 12.

In view of the need of lubricant between the blanket 18 and the shoe 12 problems have existed in the foregoing extended nip press in that there exists a tendency for the lubricating oil to creep around the lateral edges of the blanket 18 and contaminate the felt 16 and supported web W.

Figure 2:
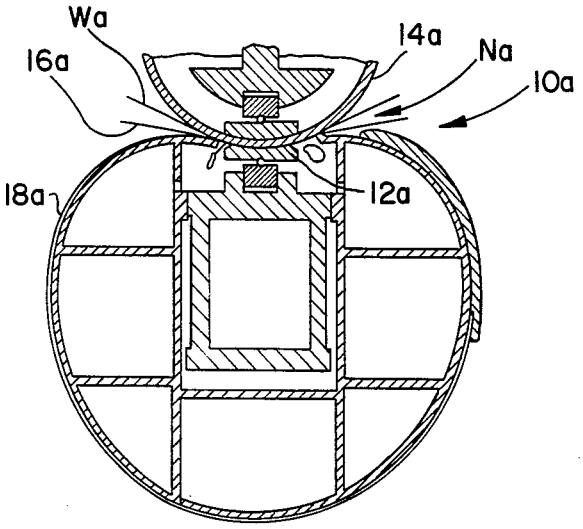
FIG. 2 PRIOR ART
FIG. 2 is a side-elevational view of a prior art "apple-type" extended nip press.

FIG. 2 is a side-elevational view of an "apple-type" extended nip press generally designated **10*a* in which the blanket 18*a* is continuously supported along the entire loop thereof so that the blanket 18*a* assumes a generally circular configuration except for the depression in the blanket 18*a* as the blanket 18*a*** extends through the extended nip Na.

In order to contain lubricant within the loop of the blanket **18*a***, proposals have been set forth such as in U.S. Pat. No. 4,673,461 assigned to Beloit Corporation issued June 16, 1987 which describes edge seals for the containment of such lubricant.

Figure 3:
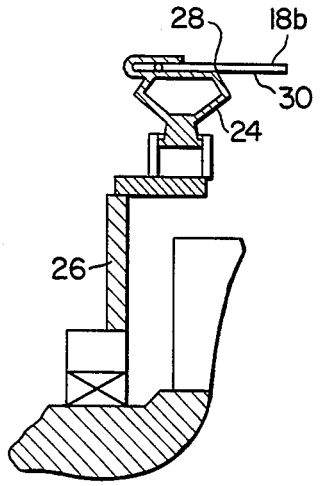
FIG. 3 PRIOR ART
FIG. 3 is a perspective view of a totally enclosed "apple type" extended nip press showing the annular rotatable blanket seal.

FIG. 3 shows one of the edge seals 24 of the aforementioned U.S. Pat. No. 4,673,461. The edge seal 24 is disposed between a rotatable head 26 and the lateral edge 28 of the blanket **18*b*. The head 26 is coaxial with the blanket 18*b* such that lubricant and lubricant mist generated in the vicinity of the shoe between the shoe and the inside surface 30 of the blanket 18*b*** is prevented from contaminating the felt or web.

However, the arrangements as shown in FIGS. 2 and 3 do not permit the provision of adjustable guide rolls 20 and 22 as in the arrangement shown in FIG. 1. In order to permit alignment of the blanket relative to the shoe the present invention provides a unique guiding apparatus.

Figure 4:
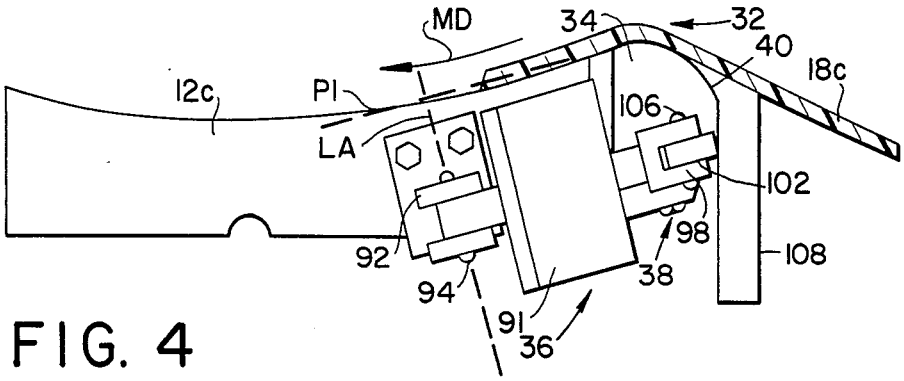
FIG. 4 is a side-elevational view of the guiding apparatus according to a first embodiment of the present invention.

FIG. 4 is a side-elevational view of the guiding apparatus generally designated 32 of the present invention for guiding an extended nip press blanket **18*c* relative to a pressing shoe 12*c*. The apparatus 32 includes a nose member 34 which is pivotally-connected to the shoe 12*c* for guiding the blanket 18*c* relative to the shoe 12*c*. Actuating means generally designated 36 are secured to the shoe 12*c* for pivoting the nose member 34 relative to the shoe 12*c*. Connecting means generally designated 38 extend between the actuating means 36 and the nose member 34 for connecting the actuating means 36 to the nose member 34 such that when the actuating means 36 is actuated, the nose member 34 is skewed relative to the shoe 12*c* so that the blanket 18*c* is guided laterally relative to the shoe 12*c* as the blanket 18*c* moves over, and in contact with, the nose member 34**.

As shown in FIG. 4, the nose member 34 defines an elongate convex surface 40 which contacts the blanket **18*c* such that the blanket 18*c* moves in a direction over the convex surface 40 of the nose member 34 onto the shoe 12*c*. More particularly, the curved surface 40 is curved convexly in a machine direction indicated by the arrow MD and cooperates with the blanket 18*c* for guiding the blanket 18*c* onto the shoe 12*c***.

Figure 5:
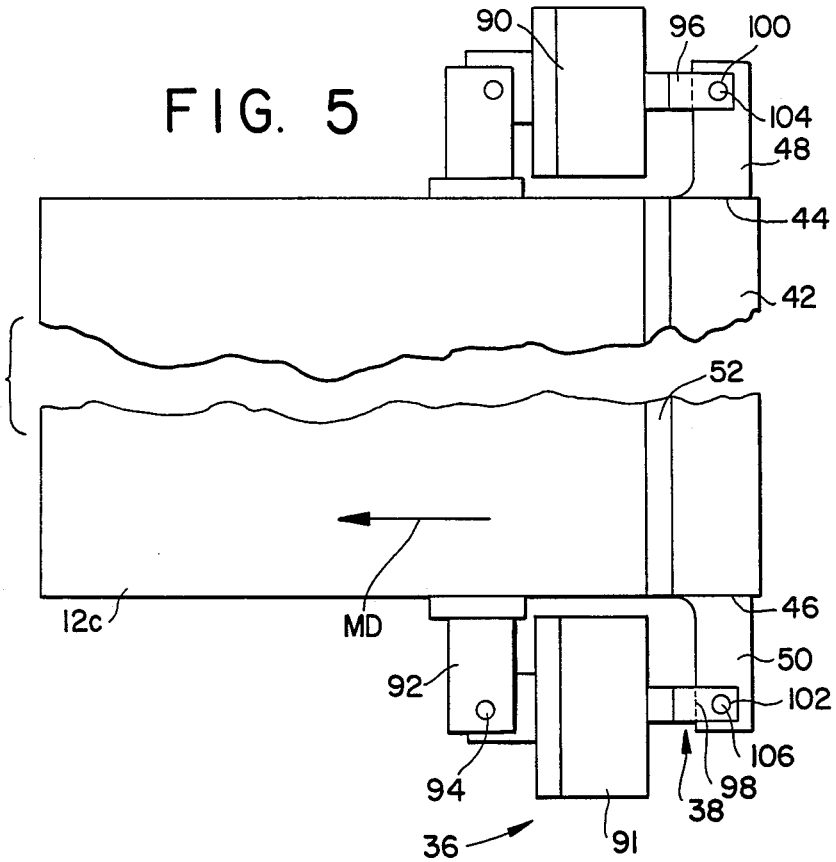
FIG. 5 is a top plan view of the embodiment shown in FIG. 4.

The nose member 34 also includes, as shown in FIG. 5, a central portion 42 which defines the curved surface 40 with the curved surface 40 cooperating with the blanket **18*c* for guiding the blanket 18*c* onto the shoe 12*c*. The central portion 42 has a first and a second end 44 and 46 respectively. A first and a second extension 48 and 50 respectively extend laterally from the first and second ends 44 and 46 respectively of the central portion 42. The central portion 42 is pivotally-connected to the shoe 12*c* such that the nose member 34 pivots midway between the first and second ends 44 and 46 of the central portion 42** as shown in FIG. 5.

Figure 6:
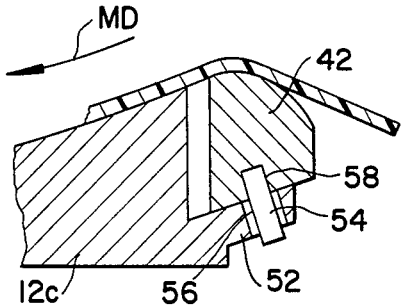
FIG. 6 is a fragmentary view similar to that shown in FIG. 4 but with the actuating means and connecting means removed to show more clearly how the nose member pivots relative to the shoe.

As shown more particularly with reference to FIG. 6, a tongue portion 52 extends from the shoe **12*c* in a direction opposite to the machine direction and a first pivot pin 54 extends from the tongue portion 52 with the first pivot pin 54 cooperating with the central portion 42 such that the nose member 34 pivots midway between the first and the second end 44 and 46 respectively of the central portion 42. As shown particularly in FIG. 6, the tongue portion 52 defines a first hole 56 for reception therein of the pin 54. The central portion 42 also defines a second hole 58 which is disposed midway between the first and the second ends 44 and 46 of the central portion 42. The second hole 58 is disposed coaxial relative to the first hole 56 such that the pin 54 extends through the holes 56 and 58 so that the nose member 34 pivots relative to the tongue portion 52**.

Figure 7:
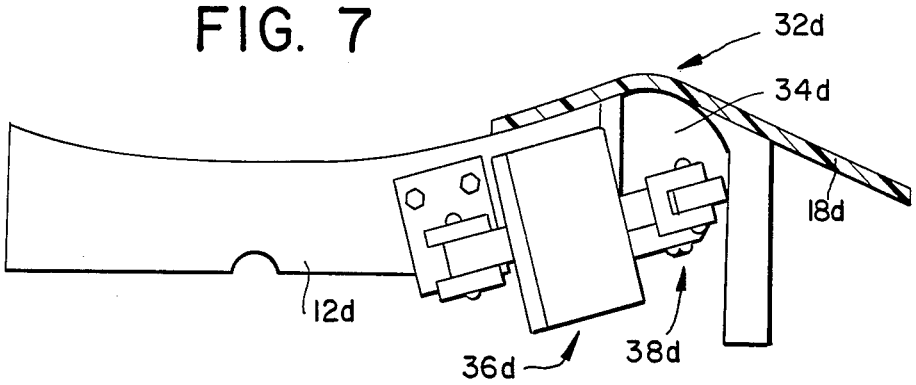
FIG. 7 is a side-elevational view of a second embodiment of the present invention.
Figure 8:
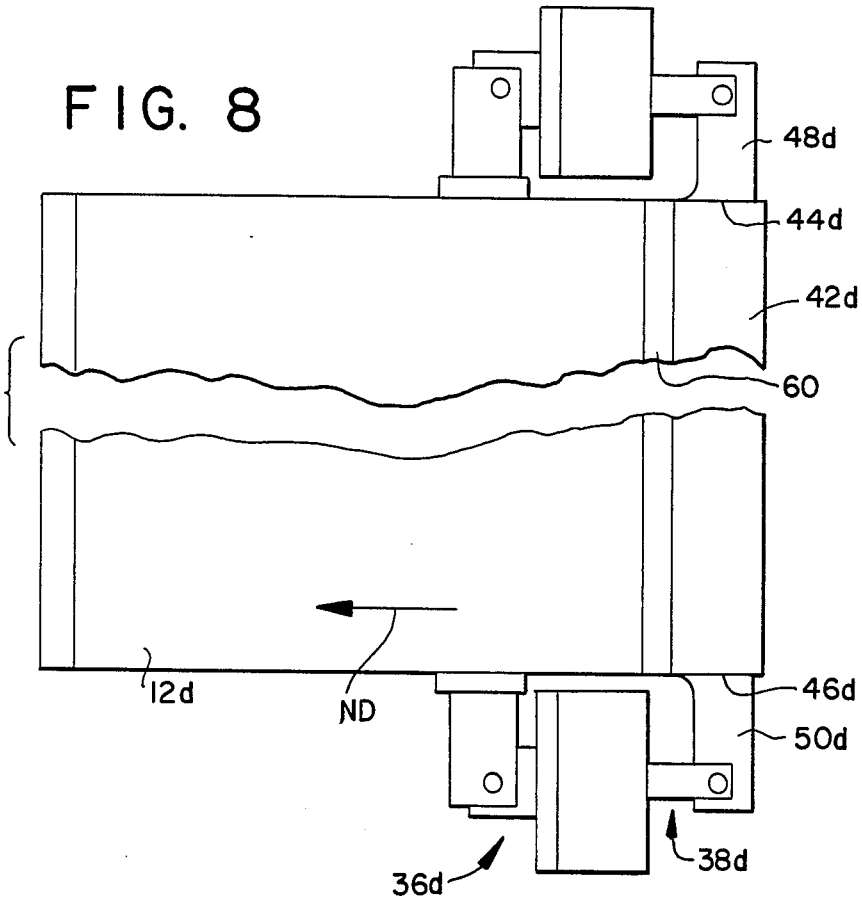
FIG. 8 is a top plan view of the embodiment shown in FIG. 7.
Figure 9:
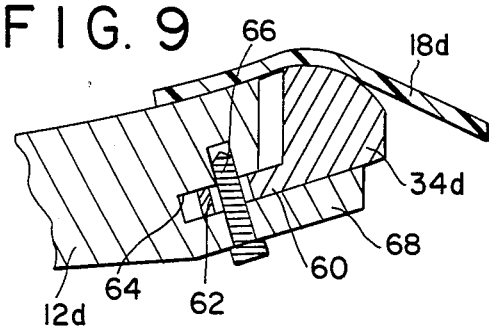
FIG. 9 is a similar view to that shown in FIG. 7 but shows the actuating means and connecting means removed in order to show more clearly how the nose member pivots relative to the shoe.

In another embodiment of the present invention, as shown in FIGS. 7 to 9, a guiding apparatus generally designated **32*d* includes a nose member 34*d* which includes a projection 60 as shown particularly in FIG. 9. The projection 60 defines a third hole 62 and the projection 60 is slidably received within a slot 64 defined by the shoe 12*d*. A second pivot pin 66 extends into the shoe 12*d* such that the second pin 66 extends through the slot 64 and the third hole 62 for pivotally-securing the nose member 34*d* relative to the shoe 12*d*. A supporting portion 68 extends from the shoe 12*d* for supporting the nose member 34*d* such that during pivotal movement of the nose member 34*d* relative to the shoe 12*d* the support portion 68 supports the nose member 34*d* with the nose member 34*d* being disposed between the blanket 18*d* and the support portion 68**.

Figure 10:
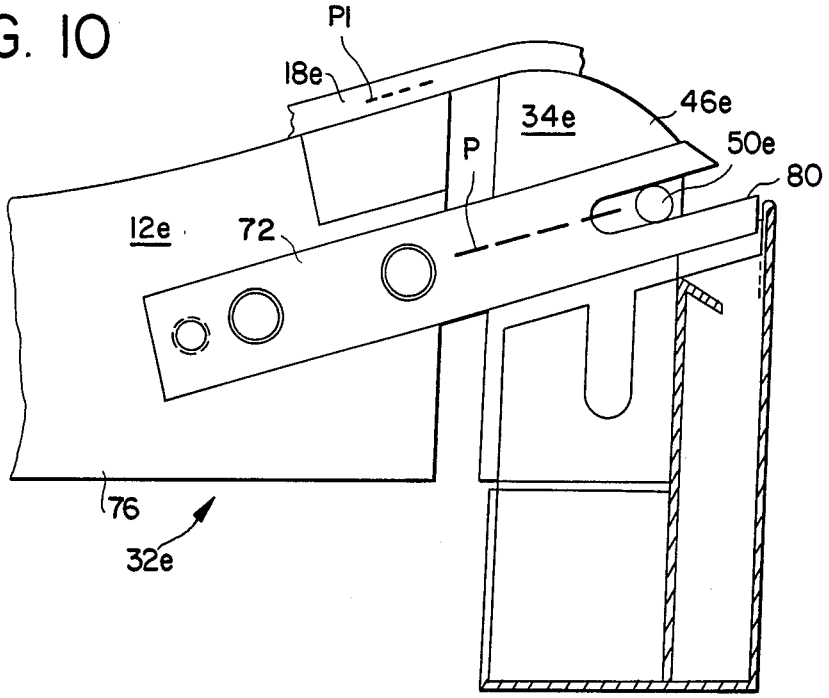
FIG. 10 is an enlarged, fragmentary side-elevational view of a third embodiment of the present invention showing the nose member supported by arms such that the nose member may be skewed relative to the shoe.
Figure 11:
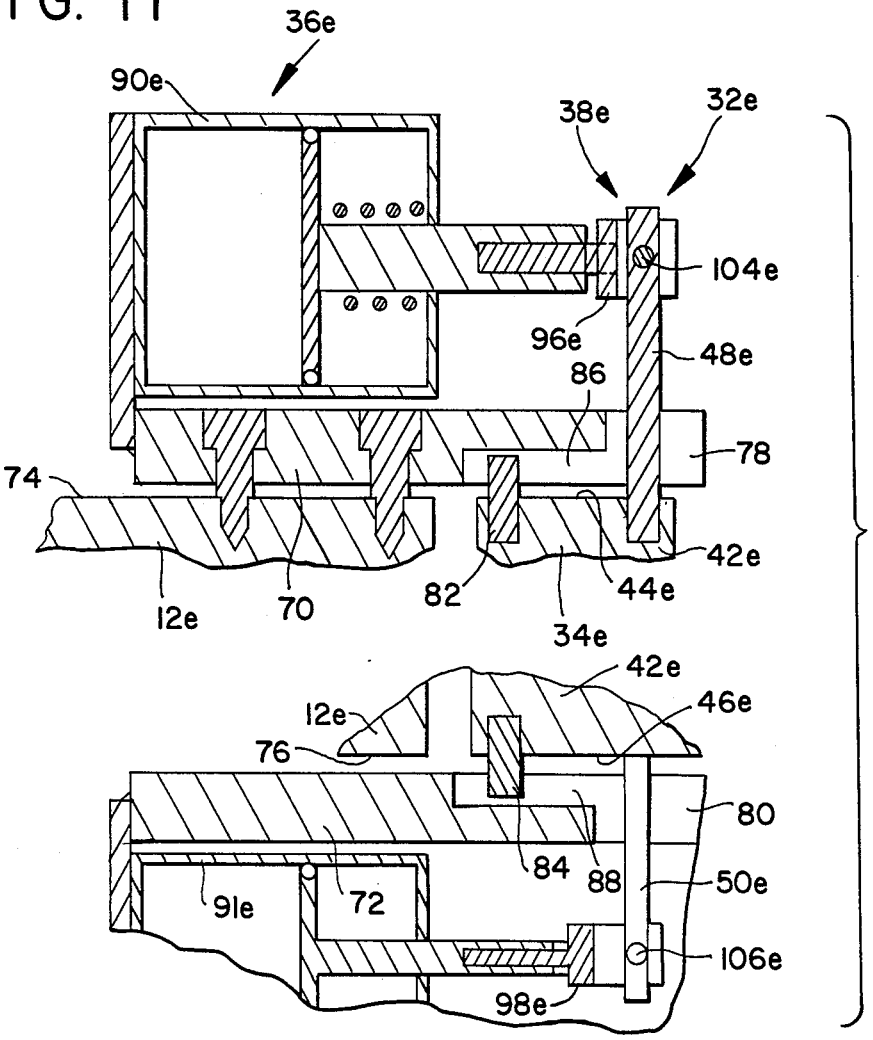
FIG. 11 is a fragmentary top sectional view of the embodiment shown in FIG. 10 showing the actuating means, connecting means and the arms extending between the shoe and the nose member.

A third embodiment of the present invention is shown in FIGS. 10 and 11. FIG. 10 is a side-elevational view of one side of the shoe and nose member. FIG. 11 is a sectional top view showing the opposite side of the shoe and nose member. FIGS. 10 and 11 show a guiding apparatus **32*e* including a first and second arm 70 and 72. The first arm 70 as shown in FIG. 11 extends from the first end 44*e* of the central portion 42*e* to a first side 74 of the shoe 12*e*. The second arm 72 as shown in FIG. 10 extends from the second end 46*e* of the central portion 42*e* to a second side 76 of the shoe 12*e*. The first arm 70 defines a first longitudinal guideway 78 for the slidable reception therein of the first extension 48*e*. The second arm 72 defines a second longitudinal guideway 80 for the slidable reception therein of the second extension 50*e* such that skewing of the nose member 34*e* relative to the shoe 12*e* is permitted. More specifically, as shown in FIG. 11, a third and fourth extension 82 and 84 respectively extend laterally relative to the central portion 42*e* with the third and fourth extensions 82 and 84 extending respectively from the first and second ends 44*e* and 46*e* of the central portion 42*e*. The first and second arms 70 and 72 define respectively first and second grooves 86 and 88 for the slidable reception therein of the third and fourth extensions 82 and 84 respectively. The first and second grooves 86 and 88 extend longitudinally relative to the first and second arms 70 and 72 respectively. The first and second grooves 86 and 88 are an extension of the first and second guideways 78 and 80 such that skewing of the central portion 42*e* relative to the shoe 12*e* is permitted with the skewing being only in a plane P which is parallel to the plane P1 of the blanket 18*e* when the blanket 18*e* is guided from the nose member 34*e* onto the shoe 12*e***.

In the first embodiment of the present invention as shown in FIGS. 4, 5 and 6, the actuating means generally designated 36 includes a first and second air cylinder 90 and 91. The air cylinder 91 is pivotally-secured to the shoe **12*c*. More specifically, the actuating means 36 also includes a clevis 92 shown with reference to FIG. 4, the clevis 92 being rigidly secured to the shoe 12*c*. A clevis pin 94 extends through the clevis 92 and the air cylinder 91 such that the air cylinder 91 is permitted to pivot relative to the shoe 12*c*. The clevis pin 94 has a longitudinal axis LA which is disposed normal to the longitudinal plane P1 of the blanket 18*c* as the blanket 18*c* is guided over the shoe 12*c*. More specifically, as shown in FIG. 4, the longitudinal axis LA of the clevis pin 94** is inclined approximately 15 degrees from the vertical.

As shown in FIGS. 4 and 5, the connecting means generally designated 38 is pivotally-connected to the first and second extensions 48 and 50 respectively such that when the actuating means 36 is actuated, the nose member 34 is skewed relative to the shoe **12*c*. More particularly, the connecting means 38 also includes a first and second bifurcated coupling 96 and 98 respectively. The first and second extensions 48 and 50 define respectively first and second bores 100 and 102. A third and fourth pivot pin 104 and 106 respectively are provided with the third pin 104 extending through the first coupling 96 and the first extension 48. The fourth pin 106 extends through the second coupling 98 and the second extension 50. The first and second couplings 96 and 98 cooperate with the first and second extensions 48 and 50 such that when the actuating means 36 is actuated, the nose member 34 is skewed relative to the shoe 12*c***.

As shown in FIG. 4, the guiding apparatus 32 also includes a lubricant supply means 108 which is secured to the nose member 34 such that the nose member 34 is disposed between the supply means 108 and the shoe **12*c* for supplying lubricant between the blanket 18*c* and the nose member 34 such that the blanket 18*c* slides over the nose member 34 and the shoe 12*c***.

In the second embodiment of the present invention as shown in FIGS. 7 to 9, the actuating means **36*d* and the connecting means 38*d* are substantially identical to the actuating means 36 and connecting means 38 of the embodiment shown in FIGS. 4 to 6**.

In the third embodiment as shown in FIGS. 10 and 11, the actuating means **36*e* includes a first and second air cylinder 90*e* and 91*e* with the first air cylinder 90*e* rigidly secured to the first arm 70 and the second actuating cylinder 91*e* rigidly secured to the second arm 72**.

FIG. 10 shows the second arm 72 with the actuating means and connecting means removed for clarity.

The connecting means **38*e* of the embodiment shown in FIGS. 10 and 11 includes a first and second bifurcated coupling 96*e* and 98*e* respectively connected by means of a third and fourth pivot pin 104*e* and 106*e* to the first and second extension 48*e* and 50*e* of the nose member 34*e* such that when the air cylinders 90*e* and 91*e* are actuated, the nose member 34*e* skews relative to the shoe 12*e* for guiding the blanket 18*e* laterally relative to the shoe 12*e***.

Figure 12:
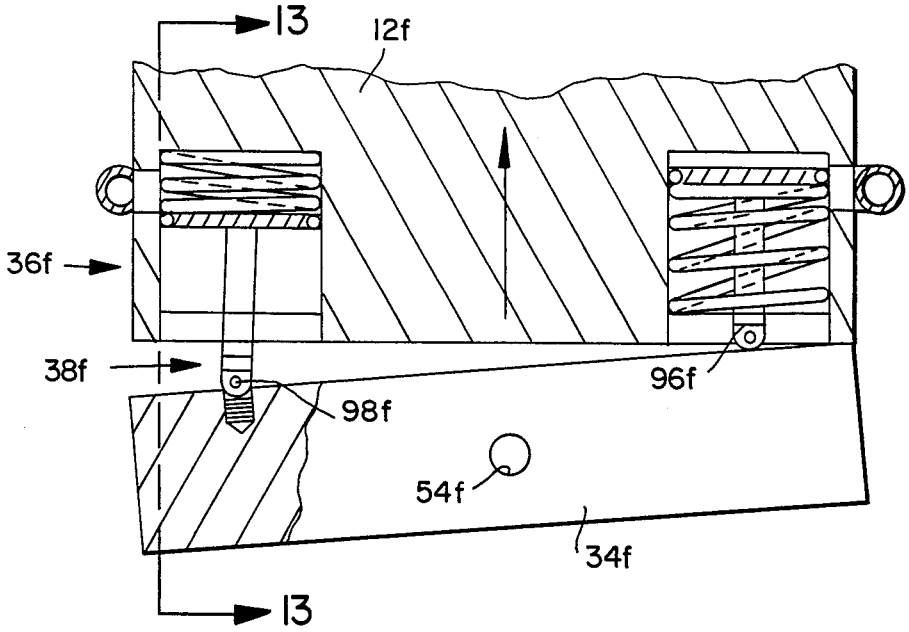
FIG. 12 is a top plan view partially in section of a fourth embodiment of the present invention showing the actuating means disposed within the shoe.
Figure 13:
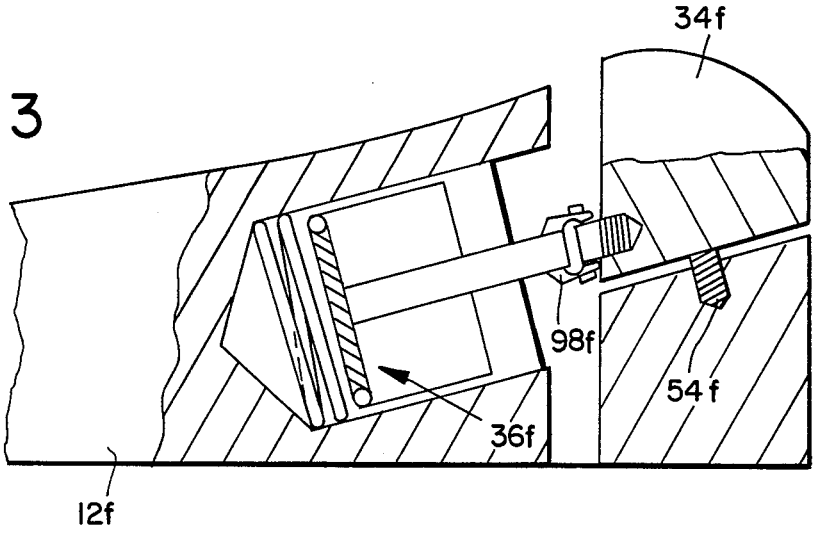
FIG. 13 is a sectional view taken on the line 13—13 of FIG. 12.

FIGS. 12 and 13 show a fourth embodiment of the present invention in which the actuating means **36*f* are disposed within the shoe 12*f*. The connecting means 38*f* includes couplings 96*f* and 98*f* such that actuation of the means 36*f* pivots the nose member 34*f* about the pivot pin 54*f***.

In all of the aforementioned embodiments, a single air cylinder could be substituted in place of the provision of an air cylinder on either side 74, 76 of the shoe and such air cylinder can be disposed on either side of the shoe. In the case of the third embodiment as shown in FIGS. 10 and 11, the nose member **34*e* is pivoted midway along the length of the central portion 42*e*** such that actuation by one air cylinder is possible.

In operation of the guiding apparatus according to the present invention, if two air cylinders are used with one air cylinder on either side, a positive pressure is applied to one cylinder and a negative pressure to the other in order to obtain the required pivotal movement of the nose member. If only one air cylinder is used in each of the embodiments shown in FIGS. 4 to 6, 7 to 9 or 10 to 11, actuation of the air cylinder causes pivoting of the nose member about the pivot pin disposed midway along the length of the nose member.

The present invention provides a simple and accurate means for remotely controlling the alignment of a blanket relative to a shoe, the aforementioned guiding apparatus being completely enclosed within a sealed extended nip press blanket.

What is claimed is:

1. In an extended nip press having a blanket and a pressing shoe, a guiding apparatus for guiding the extended nip press blanket relative to the pressing shoe, said apparatus comprising:

a nose member pivotally-connected to the shoe for guiding the blanket relative to the shoe;

actuating means secured to the shoe for pivoting said nose member relative to the shoe; and connecting means extending between said actuating means and said nose member for connecting said actuating means to said nose member such that when said actuating means is actuated, said nose member is skewed relative to the shoe so that the blanket is guided laterally relative to the shoe as the blanket moves over, and in contact with, said nose member.

2. A guiding apparatus as set forth in claim 1 wherein said nose member defines an elongate, convex surface which contacts the blanket such that the blanket moves in a direction over said convex surface of said nose member onto the shoe.

3. A guiding apparatus as set forth in claim 1 wherein said nose member defines an elongate, curved surface, said curved surface being curved convexly in a machine direction and cooperating with the blanket for guiding the blanket onto the shoe.

4. A guiding apparatus as set forth in claim 1 wherein said nose member further includes:

a central portion defining a curved surface, said curved surface cooperating with the blanket for guiding the blanket onto the shoe, said central portion having a first and a second end;

a first and a second extension, said extensions extending laterally from said first and second end respectively of said central portion.

5. A guiding apparatus as set forth in claim 4 wherein said central portion is pivotally-connected to the shoe such that said nose member pivots midway between said first and second end of said central portion.

6. A guiding apparatus as set forth in claim 5 further including:

a tongue portion extending from the shoe in a direction opposite to the machine direction;

a first pivot pin extending from said tongue portion, said first pivot pin cooperating with said central portion such that said nose member pivots midway between said first and second end of said central portion.

7. A guiding apparatus as set forth in claim 6 wherein said tongue portion defines a first hole for the reception therein of said pin;

said central portion defining a second hole disposed midway between said first and second end of said central portion, said second hole being disposed coaxial relative to said first hole such that said pin extends through said holes so that said nose member pivots relative to said tongue portion.

8. A guiding apparatus as set forth in claim 5 wherein said nose member further includes:

a projection, said projection defining a hole;

said projection being slidably received within a slot defined by the shoe;

a pivot pin extending into the shoe such that said pin extends through said slot and said hole for pivotally securing said nose member relative to the shoe;

a supporting portion extending from the shoe for supporting said nose member such that during pivotal movement of said nose member relative to the shoe, said support portion supports said nose member with said nose member being disposed between the blanket and said support portion.

9. A guiding apparatus as set forth in claim 4 further including:

a first and second arm, said first arm extending from said first end of said central portion to a first side of the shoe;

said second arm extending from said second end of said central portion to a second side of the shoe;

said first arm defining a first longitudinal guideway for the slidable reception therein of said first extension:

said second arm defining a second longitudinal guideway for the slidable reception therein of said second extension such that skewing of said nose member relative to the shoe is permitted.

10. A guiding apparatus as set forth in claim 9 further including:

a third and fourth extension extending laterally relative to said central portion, said third and fourth extensions extending respectively from said first and second ends of said central portion;

said first and second arms defining respectively first and second grooves for the slidable reception therein of said third and fourth extensions respectively, said first and second grooves extending longitudinally relative to said first and second arms respectively, said first and second grooves being an extension of said first and second guideway such that skewing of said central portion relative to said shoe is permitted, said skewing being only in a plane parallel to the plane of the blanket when the blanket is guided from said nose member onto the shoe.

11. A guiding apparatus as set forth in claim 1 wherein said actuating means is an air cylinder, said air cylinder being pivotally secured to the shoe.

12. A guiding apparatus as set forth in claim 11 wherein said actuating means further includes:

a clevis rigidly secured to the shoe;

a clevis pin extending through said clevis and said air cylinder such that said air cylinder is permitted to pivot relative to the shoe.

13. A guiding apparatus as set forth in claim 12 wherein said clevis pin has a longitudinal axis which is disposed normal to the longitudinal plane of the blanket as the blanket is guided over the shoe.

14. A guiding apparatus as set forth in claim 4 wherein said connecting means is pivotally-connected to said first and second extensions respectively such that when said actuating means is actuated, said nose member is skewed relative to the shoe.

15. A guiding apparatus as set forth in claim 14 wherein said connecting means further includes:

a first and a second bifurcated coupling;

said first and second extensions defining respectively, first and second bores;

a third and fourth pivot pin, said third pin extending through said first coupling and said first bore of said first extension, said fourth pin extending through said second coupling and said second bore of said second extension;

said first and second couplings cooperating respectively with said first and second extensions such that when said actuating means is actuated, said nose member is skewed relative to the shoe.

16. A guiding apparatus as set forth in claim 1 further including:

a lubricant supply means secured to said nose member such that said nose member is disposed between said supply means and the shoe for supplying lubricant between the blanket and said nose member such that the blanket slides over said nose member and the shoe.

17. In an extended nip press having a blanket and a pressing shoe, a guiding apparatus for guiding the extended nip press blanket relative to the pressing shoe, said apparatus comprising a nose member pivotally-connected to the shoe for guiding the blanket relative to the shoe, said nose member further including:

a central portion defining a curved surface, said curved surface cooperating with the blanket for guiding the blanket onto the shoe, said central portion having a first and a second end;

a first and a second extension, said extensions extending laterally from said first and second ends respectively of said central portion;

said central portion being pivotally-connected to the shoe such that said nose member pivots midway between said first and second end of said central portion;

actuating means secured to the shoe for pivoting said nose member relative to the shoe; and connecting means extending between said actuating means and said nose member for connecting said actuating means to said nose member such that when said actuating means is actuated, said nose member is skewed relative to the shoe so that the blanket is guided laterally relative to the shoe as the blanket moves over, and in contact with, said nose member.

18. A method of guiding an extended nip press blanket relative to a pressing shoe of an enclosed "apple type" extended nip press, the method comprising the steps of:

pivotally-connecting a nose member relative to the pressing shoe of the extended nip press; and actuating an air cylinder extending between the shoe and the nose member such that the nose member is skewed relative to the shoe so that the blanket is guided laterally relative to the shoe as the blanket moves over, and in contact with, the nose member.

* * * * *